US006851889B2

(12) United States Patent
Buchanan

(10) Patent No.: US 6,851,889 B2
(45) Date of Patent: Feb. 8, 2005

(54) REINFORCED INTERLOCKING RETENTION PANELS

(76) Inventor: Gregory J. Buchanan, 16822 Baruna La., Huntington Beach, CA (US) 92649

( * ) Notice: Subject to any disclaimer, the term of this patent is extended or adjusted under 35 U.S.C. 154(b) by 0 days.

(21) Appl. No.: 10/419,546

(22) Filed: Apr. 21, 2003

(65) Prior Publication Data

US 2004/0208702 A1 Oct. 21, 2004

(51) Int. Cl.[7] ..... E02B 3/04

(52) U.S. Cl. ..... 405/31; 405/15; 405/285; 405/302.6; 256/13

(58) Field of Search ..... 405/15, 20, 21, 405/22, 30, 31, 34, 262, 274, 277, 278, 281, 285, 302.6; 256/13, 15, 24, 31; 52/309.1, 309.12, 606.01

(56) References Cited

U.S. PATENT DOCUMENTS

| | | | | | |
|---|---|---|---|---|---|
| 830,437 | A | * | 9/1906 | Humphrey | 405/113 |
| 3,820,294 | A | * | 6/1974 | Parker | 52/262 |
| 4,078,348 | A | * | 3/1978 | Rothman | 52/309.7 |
| 4,185,437 | A | * | 1/1980 | Robinson | 52/601 |
| 4,453,359 | A | * | 6/1984 | Robinson | 52/389 |
| 4,641,468 | A | * | 2/1987 | Slater | 52/309.4 |
| 4,674,921 | A | * | 6/1987 | Berger | 405/262 |
| 4,690,588 | A | | 9/1987 | Berger | |
| 4,777,774 | A | * | 10/1988 | Smalley, III | 52/282.3 |
| 4,917,543 | A | * | 4/1990 | Cole et al. | 405/262 |
| 5,066,353 | A | | 11/1991 | Bourdo | |
| 5,069,579 | A | * | 12/1991 | Burns | 405/25 |
| 5,114,270 | A | | 5/1992 | Riddle | |
| 5,145,287 | A | | 9/1992 | Hooper et al. | |
| 5,305,568 | A | | 4/1994 | Beckerman | |
| 5,486,391 | A | * | 1/1996 | Tyner | 428/44 |
| 5,600,930 | A | * | 2/1997 | Drucker | 52/585.1 |
| 5,644,884 | A | * | 7/1997 | Dobija | 52/506.01 |
| 5,776,582 | A | | 7/1998 | Needham | |
| 5,792,552 | A | * | 8/1998 | Langkamp et al. | 428/309.9 |
| 6,443,655 | B1 | * | 9/2002 | Bennett | 405/114 |
| 2002/0023401 | A1 | * | 2/2002 | Budge | 52/426 |
| 2002/0054791 | A1 | | 5/2002 | Nottingham | |
| 2002/0122954 | A1 | * | 9/2002 | Dagher | 428/537.1 |
| 2003/0167716 | A1 | * | 9/2003 | Messenger et al. | 52/309.12 |

FOREIGN PATENT DOCUMENTS

| | | | |
|---|---|---|---|
| DE | 2719448 | * | 11/1978 |

* cited by examiner

*Primary Examiner*—Jong-Suk (James) Lee

(57) ABSTRACT

A system of composite panels comprised of resin impregnated carbon fiber sheets, on opposing sides of a fiberglass core, having structural values directly related to the thickness of the core and the amount of carbon fiber incorporated, to be used in marine conditions to resist scour or erosion while retaining soil materials behind the panel and resisting hydrostatic loads. Each panel will have high-density polyethylene (HDPE) interlocks on opposite edges allowing the panels to slide together allowing a series of joined panels to form a continuous wall. Additionally the preformed HDPE interlocks may be field-installed and removed allowing the carbon fiber panels to be cut to a specific dimension as necessary.

19 Claims, 6 Drawing Sheets

REINFORCED INTERLOCKING RETENTION PANELS

FIELD OF THE INVENTION

Various embodiments of the invention pertain to the prevention and/or elimination of shoreline erosion and/or scour beneath marine structures. More particularly, at least one embodiment of the invention relates to a bulkhead system of interlocking carbon-reinforced panels with improved strength.

DESCRIPTION OF RELATED ART

Currently, the most common methods for stabilizing earth materials or earth materials beneath structures in a marine environment are either the placement of rock protection or constructing a bulkhead by the driving of steel, fiberglass, aluminum or vinyl sheet pile adjacent to the material to be protected. Though these methods can be adequate, each has inherent disadvantages.

Placement of rock may require encroachment into properties owned by others or areas sensitive with environmental constraints. Conventional steel sheet or aluminum pile may also experience the same encroachment problems and the metallic pile, in a marine condition, is highly subject to corrosion. Additionally, placement of steel sheet pile or rock protection requires the use of heavy equipment along with adequate access. Vinyl and fiberglass sheet pile have very little structural value and are generally utilized in conjunction with rock protection.

DETAILED DESCRIPTION OF THE PREFERRED EMBODIMENTS

In the following description numerous specific details are set forth in order to provide a thorough understanding of the invention. However, one skilled in the art would recognize that the invention may be practiced without these specific details. In other instances, well known methods, procedures, and/or components have not been described in detail so as not to unnecessarily obscure aspects of the invention.

Various aspects of the invention provide a novel bulkhead wall including an interlocking system of reinforced panels that may be employed, for example, to stabilize or protect structures along a shoreline. A bulkhead wall of fiber-reinforced panels, having structural values directly related to the thickness of the panel core and the amount of reinforcing fiber incorporated therein may be use in marine conditions to resist scour or erosion while retaining soil materials behind the panel and resisting hydrostatic loads.

Figure 1:
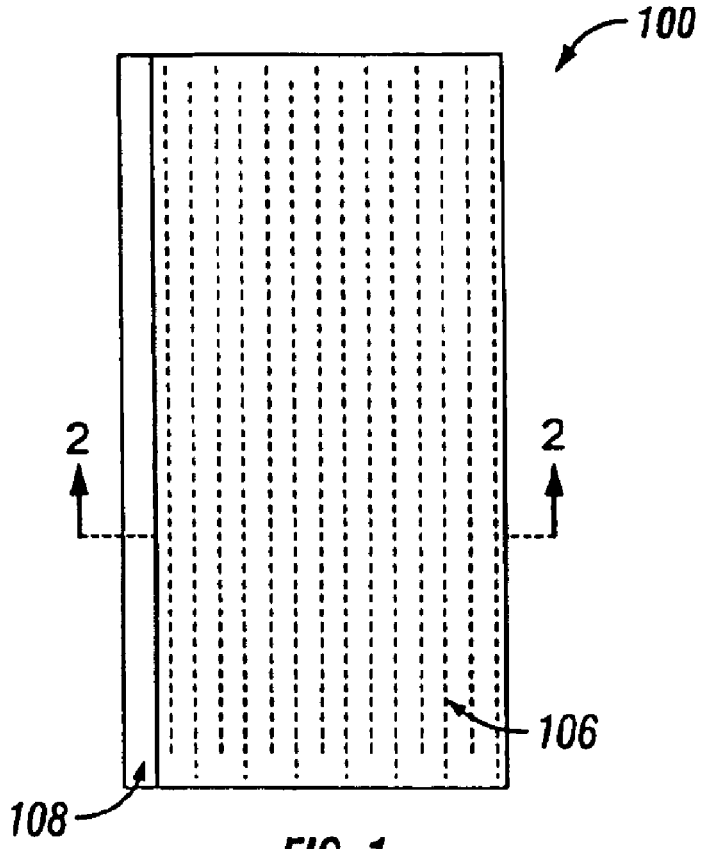
FIGS. 1 and 2 illustrate a reinforced retention panel according to one embodiment of one aspect of the invention.
Figure 2:
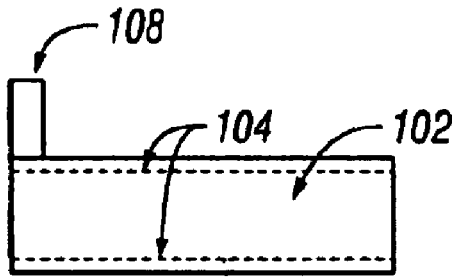

FIGS. 1 and 2 illustrate a reinforced retention panel 100 according to one embodiment of one aspect of the invention. The panel 100 includes a core 102 reinforced by one or more layers of reinforcing fiber 104. The reinforcing fiber 104 may be carbon fiber or any other material which serves to reinforce and/or strengthen the panel 100. In one implementation, the layers of reinforcing carbon fiber 104 may be arranged near the faces of the panel 100.

According to one embodiment of the invention, the reinforcing layers of carbon fiber 104 include unidirectional fiber 106 running substantially parallel to the longitudinal axis of the panel 100. The longitudinal axis of the panel 100 being substantially parallel to direction in which the panels are to be driven into the ground. In another embodiment, the reinforcing carbon fiber may be weaved or arranged in various other configurations are directions, relative to the longitudinal axis of the panel, (e.g., perpendicular, diagonal, etc.) to strengthen the panel 100.

According to one embodiment of the invention, the core 102 may be a fiberglass core. In other embodiments, other materials may be used which provide stiffness and strength to the panel 100.

In one embodiment of the invention, the panel 100 includes a lug or blockhead 108 on one edge of the panel 100 along the longitudinal axis of the panel 100. As described below, this lug or blockhead 108 permits longitudinal movement of a panel while interlocked to other panels. For example, the panel 100 may be driven to a specified depth without affecting other interlocked panels. In another embodiment of the invention, the panel 100 may include lugs or blockheads 108, along the longitudinal sides of the panel 100. The lug or blockhead 108 may be attached to the panel using epoxy, or any other conventional method. In another embodiment, the lug or blockhead 108 is manufactured as an integral part of the panel 100.

Figure 3:
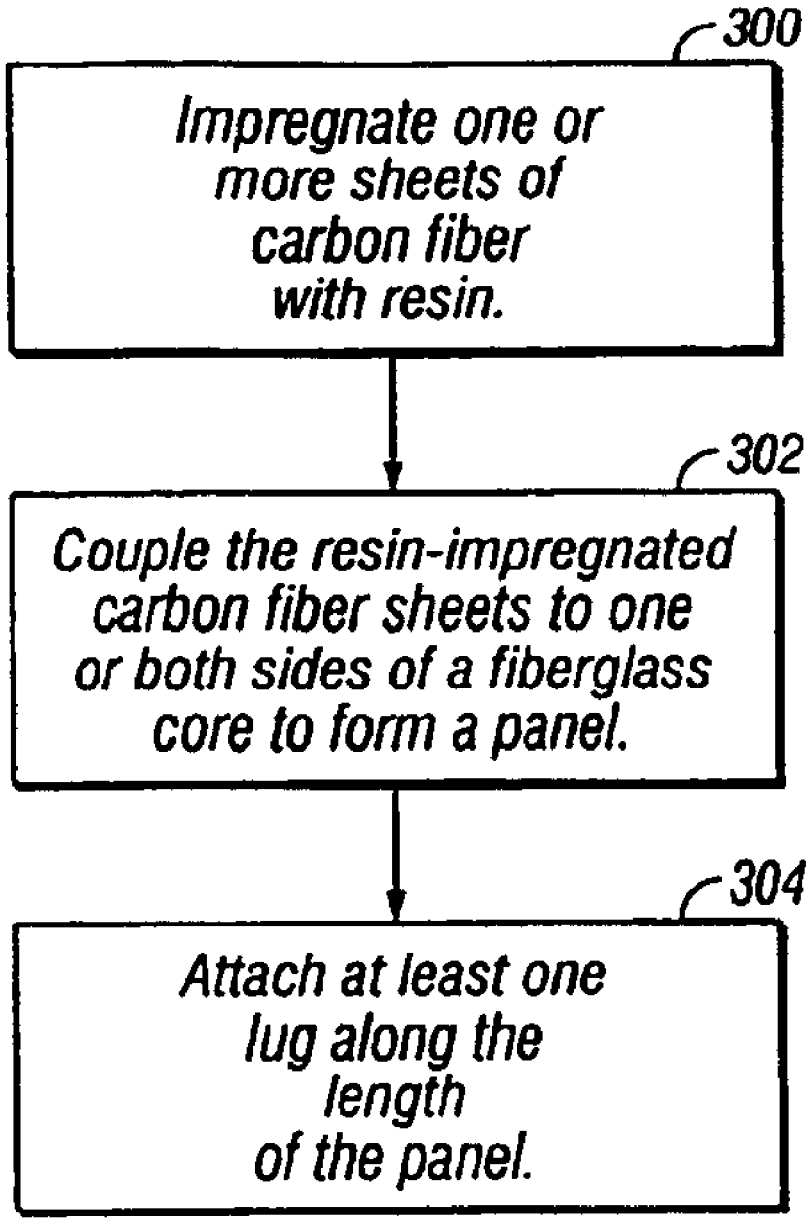
FIG. 3 illustrates a method of manufacturing fiber-reinforced panels according to one aspect of one embodiment of the invention.

FIG. 3 illustrates a method of manufacturing fiber-reinforced panels according to one aspect of one embodiment of the invention. One or more layers of resin-impregnated carbon fiber sheets 300 are coupled to one or both sides of a fiberglass core 302. The structural strength of the panel having structural values directly related to the thickness of the fiberglass core, the amount of carbon fiber incorporated therein, and/or the type of resin used to bind the carbon fiber sheet(s) to the fiberglass core.

In one embodiment of the invention, the carbon fiber sheet(s) is impregnated with polyester resin. In another embodiment of the invention, a vinyl ester resin is employed to impregnate and bind the carbon fiber sheet(s) to the fiberglass core. In one implementation, each layer of carbon-fiber and resin may total approximately 1/16 of an inch in thickness to the reinforced panel.

A lug is attached or created along the length and edge of the panel 304. Thus, the panels have increased strength, are relatively lightweight, and are inert to environmental conditions, such as corrosion.

The carbon fiber reinforced panels disclosed by this invention are unexpectedly strong in comparison to mere fiberglass panels. Tables 1, below, illustrates the result of load tests performed on polyester resin-impregnated carbon fiber panels with a fiberglass core. The overall thickness of the panels are about ⅝ of an inch, including the fiberglass core. The testing involved samples approximately 2 inches by 9 inches long with the carbon fibers positioned perpendicular to the load. As seen from the Maximum Load results, the carbon fiber reinforced panel samples were able to withstand maximum loads in the 3600 pound range representing an average modulus of rupture of 41162 pounds per square inch.

TABLE 1

Carbon Fiber-Reinforced Fiberglass Panels Polyester Resin

| Sample # | Max. Load (lbs) | Thickness (in.) | Width (in.) | Span (in.) | Modulus of Rupture(p.s.i.) |
|---|---|---|---|---|---|
| 1 | 3744 | 0.6395 | 2.0515 | 9.00 | 40163 |
| 2 | 3606 | 0.6115 | 2.1535 | 9.00 | 40302 |
| 3 | 3658 | 0.6015 | 2.1390 | 9.00 | 42541 |
| 4 | 3478 | 0.5915 | 2.1485 | 9.00 | 41642 |

Table 2, below, illustrates the result of load tests performed on reinforced fiberglass panels similar to those show in Table 1, above, but reinforced with carbon fiber impregnated with vinyl ester resin. The testing involved samples approximately 2 inches by 9 inches long with the carbon fibers positioned perpendicular to the load. As seen from the Maximum Load results, the carbon fiber reinforced panel samples were able to withstand maximum loads in the 3900 pound range representing an average modulus of rupture of 47747 pounds per square inch. These tests show that for panel samples of similar dimensions, the use of vinyl ester resin to impregnate or bond the carbon fiber to the panels increases the strength of the panels more than the use of polyester resin for the same purpose.

The panels in Samples #2–12, in Table 2, were submerged in saturated salt water over several months prior to the test to determine if the marine environment degrades the panels' structural properties. As the results indicate, the salt water conditions did not affect the strength of the reinforced panels.

TABLE 2

Carbon Fiber-Reinforced Fiberglass Panels Vinyl Ester Resin

| Sample # | Max. Load (lbs) | Thickness (in.) | Width (in.) | Span (in.) | Modulus of Rupture(p.s.i.) |
|---|---|---|---|---|---|
| 1 (Dry) | 4100 | 0.6285 | 2.0084 | 9.00 | 46512 |
| 2 (Wet) | 4006 | 0.6250 | 2.0004 | 9.00 | 46140 |
| 3 (Wet) | 3960 | 0.6265 | 2.0083 | 9.00 | 45210 |
| 4 (Wet) | 4456 | 0.6205 | 1.9954 | 9.00 | 52201 |
| 5 (Wet) | 4310 | 0.6265 | 2.0015 | 9.00 | 49376 |
| 6 (Wet) | 4092 | 0.6225 | 1.9874 | 9.00 | 47821 |
| 7 (Wet) | 3928 | 0.6125 | 1.9874 | 9.00 | 47414 |
| 8 (Wet) | 3930 | 0.6115 | 1.9818 | 9.00 | 47730 |
| 9 (Wet) | 3830 | 0.6050 | 1.9764 | 9.00 | 47645 |
| 10 (Wet) | 3870 | 0.6045 | 1.9957 | 9.00 | 47760 |
| 11 (Wet) | 3910 | 0.6095 | 1.9915 | 9.00 | 47566 |
| 12 (Wet) | 3795 | 0.6025 | 1.9730 | 9.00 | 47588 |

Table 3, below, illustrates the same load test illustrated above, with respect to Tables 1 and 2, but performed on a fiberglass samples ranging from 7/16 to nearly ½ inch thick. As with the above test, fiberglass samples are approximately 2 inches by 9 inches. As can be seen from these tests, the unreinforced fiberglass has much lower maximum loads, in the 600 to 718 lbs. range representing an average modulus of rupture of 14400 pounds per square inch. Although the fiberglass cores used in the two tests were of slightly different thicknesses, the fiberglass cores in Table 1 and 2 were approximately ½ inch thick while the core in Table 3 was 7/16 to ½ inch thick, the increased maximum load strength exhibited by the carbon fiber reinforced panels was still significantly greater than would have been expected.

TABLE 3

Fiberglass Panels

| Sample # | Max. Load (lbs) | Thickness (in.) | Width (in.) | Span (in.) | Modulus of Rupture(p.s.i.) |
|---|---|---|---|---|---|
| 1 | 660 | 0.4355 | 2.0050 | 9.00 | 15621 |
| 2 | 714 | 0.4930 | 2.0000 | 9.00 | 13220 |
| 3 | 608 | 0.4380 | 1.9950 | 9.00 | 14297 |
| 4 | 718 | 0.4715 | 2.0100 | 9.00 | 14461 |

Figure 4:
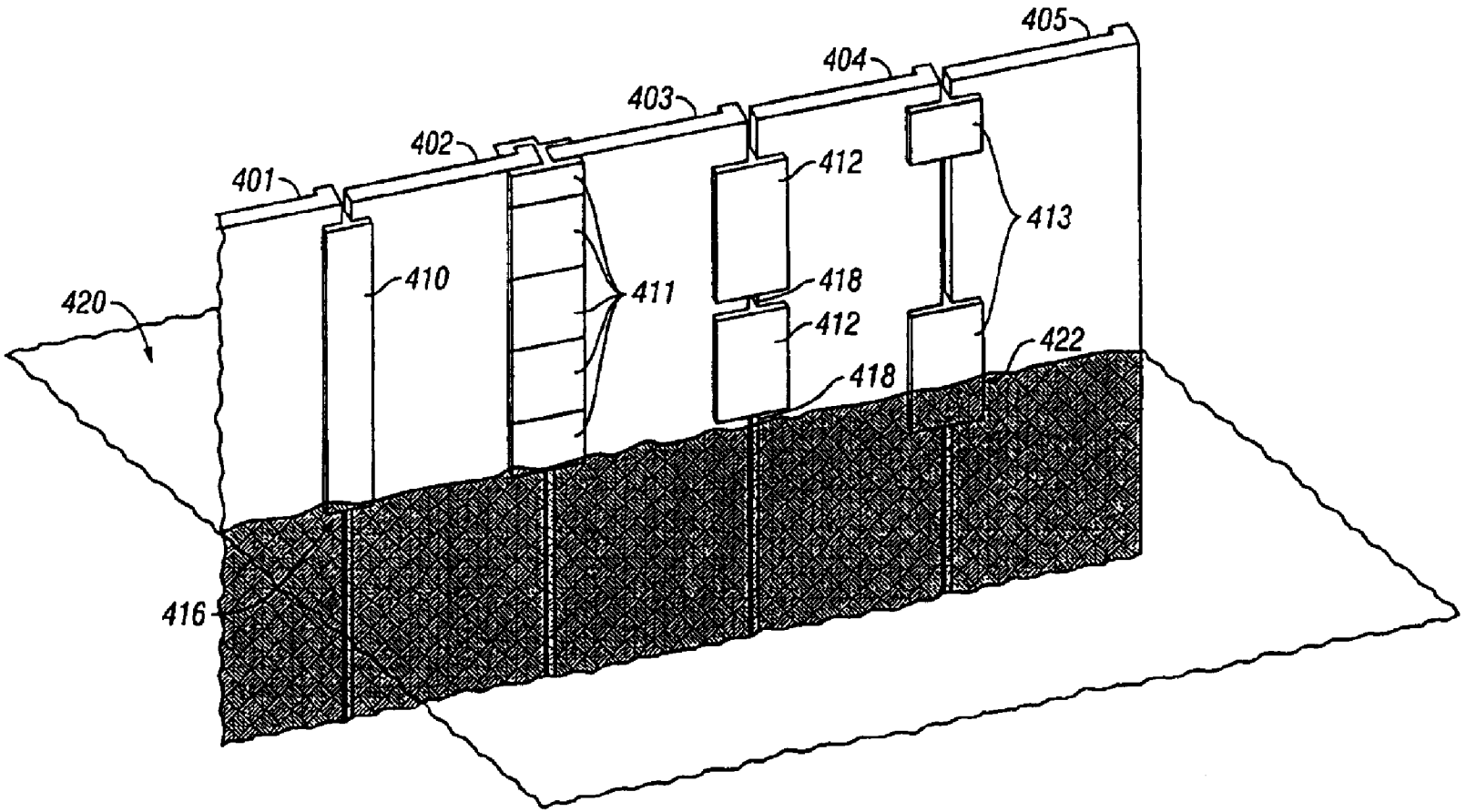
FIG. 4 illustrates how a plurality of fiber-reinforced panels, according to one embodiment of the invention, may be joined using various interlocks, according to various embodiments of the invention, in one implementation of the invention.

FIG. 4 illustrates how a plurality of carbon fiber-reinforced panels 401–405, according to one embodiment of the invention, may be joined using various interlocks 410–413, according to various embodiments of the invention, to create a continuous bulkhead wall in one implementation of the invention. The plurality of carbon fiber-reinforced panels 401–405 are joined with sliding interlocks 410–413 along their edges. Each individual panel 401–405 may be driven into the ground 416 to a specified vertical depth along the outboard face of the structure or material whose sub-grade 420 is to be stabilized or protected. The panels 401 may include one or more lugs to permit the panels to slide up and down, with relation to the interlocks 410–413, while preventing the panels from separating from the interlock and/or an adjoining panel. The tops of the panels may be anchored with bolts, tieback anchors, or a wailer system as necessary to provide support to resist all lateral loads.

Because the carbon fiber-reinforced panels are relatively strong and are lightweight, the bulkhead or reinforcing wall is easy to assemble, capable of withstanding heavier loads, and provides for flexible field modifications.

As illustrated in FIG. 4, various types of interlock arrangements may be used depending on the implementation. In one embodiment of the invention, a single interlock 410 may be used to join to fiber-reinforced panels 401–402 while filling any gaps between the panels 401–402. The interlock 410 may run from, approximately, the surface of the ground to, approximately, the top of the panels 401–402. In another implementation, the interlocks 411 may be of sectioned into multiple interlocks 411 that can be stacked to join or couple the panels 402–403 while filling any gaps between the panels 402–403.

In yet other implementations, the interlocks 412 and 413 need not run continuously from the ground to the top of the fiber-reinforced panels 403–405. Instead, the interlocks may be arranged to create a gap between interlocks. This gap may be as large or small as the implementation requires. For example, a small gap or gaps 418 may be created to permit water to drain out while still preventing erosion of the sub-grade 420 being protected.

In yet other implementations, the interlock 422 may run below the ground 420 level to provide greater protection against erosion.

Figure 5:
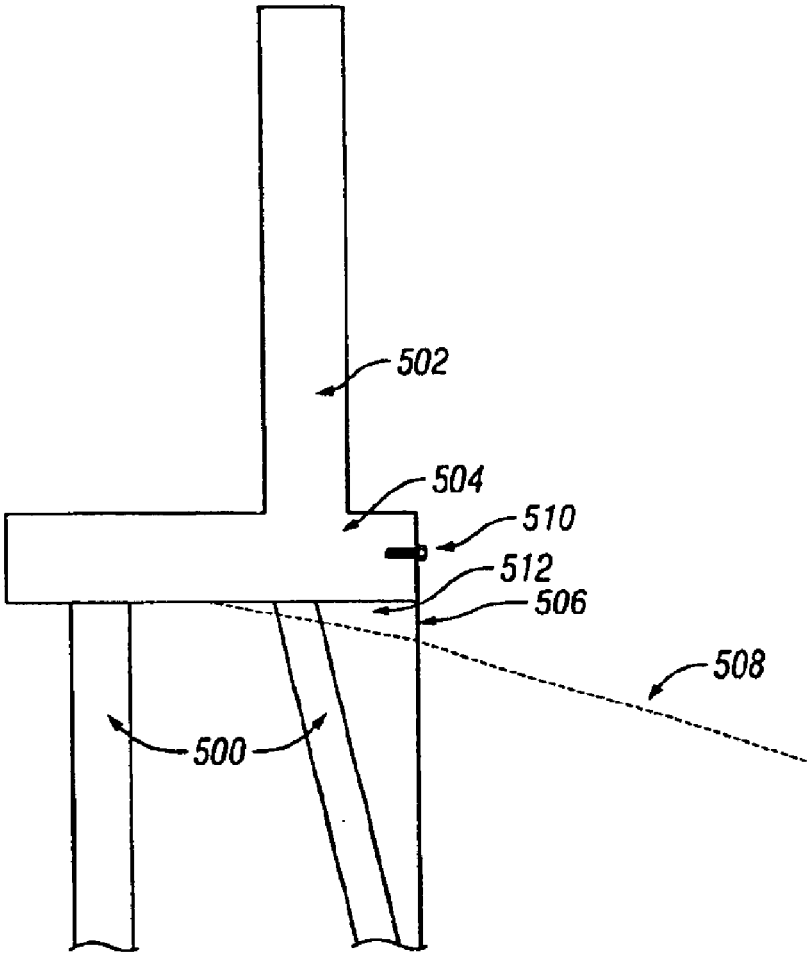
FIG. 5 illustrates how seawall support pilings may be protected according to one implementation of the fiber-reinforced panels and interlocking system of one embodiment of the present invention.

FIG. 5 illustrates how seawall support pilings 500 may be protected according to one implementation of the fiber-reinforced panels and interlocking system of one embodiment of the present invention. The timber piling 500 that support the seawall 502 are subject to attack by marine borers when the sea bottom 508 scours below the footing 504 and exposes these piles 500. A carbon fiber-reinforced panel 504 may be driven into the sea bottom 508 and then secured to the seawall footing 504 with stainless steel bolts 510.

In one implementation of the invention, if voids 512 exist beneath the structure being stabilized or protected, these voids 512 can be filled with pressurized grout utilizing holes drilled through the panel 506. Sealing of these holes is unnecessary since they are completely filled when the grouting operation is completed.

Figure 6:
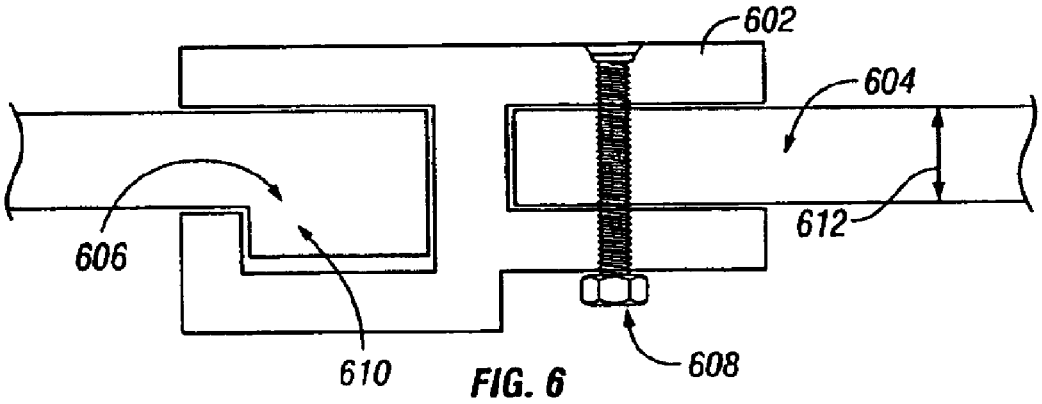
FIG. 6 illustrates a top view of two fiber-reinforced panels joined by an interlock according to one embodiment of the invention.

FIG. 6 illustrates a top view of two fiber-reinforced panels joined by an interlock according to one embodiment of the invention. In one embodiment of the invention, the interlock system 602 may be composed of high-density polyethylene (HDPE). The interlock 602 serves to join two fiber-reinforced panels 604 and 606.

A first panel 604 is secured to the interlock 602 with one or more fasteners or bolts 608. In one implementation, the one or more bolts may be stainless steel bolts or fasteners. In other implementation, the bolts or fasteners may be of other materials which are resistant to corrosion or which have characteristics desirable for a particular implementation.

A second panel 606 has a continuous lug 610, along one edge of the panel 606. In various implementations of the invention, the lug 610 may be integral with the panel 606 or a separate component which is attached to the panel 606. In one embodiment of the invention, the lug 610 is made of fiberglass and integral with the panel 606. The lug 610 slides longitudinally along a groove in the interlock 602. This interlocking groove allows longitudinal movement of the panel to accommodate driving of each individual panel into the ground while restraining from undesired movement along the other two axes. That is, the interlocking grooves permit the panels to slide up or down but prevents two panels from separating.

In one implementation of the invention, every panel has a lug 610 along one side in the longitudinal direction. The fiber-reinforced panels 604 and 606 may be cut to size in the field or during installation as conditions dictate. When using panels with a single lug along one longitudinal side or edge, the panels may be cut to the desired width along the non-lug side or edge. The cut panel (e.g., 604) can still be joined to other panels by using interlock 602.

In one implementation of the invention, the thickness 612 of the fiber-reinforced panels 604 and 606 is uniform, except for the lug portion 610. For example, in one implementation the panels are half an inch thick. Other fiber-reinforced panels may be manufactured thicker or thinner according to the desired strength for a given implementation.

Figure 7:
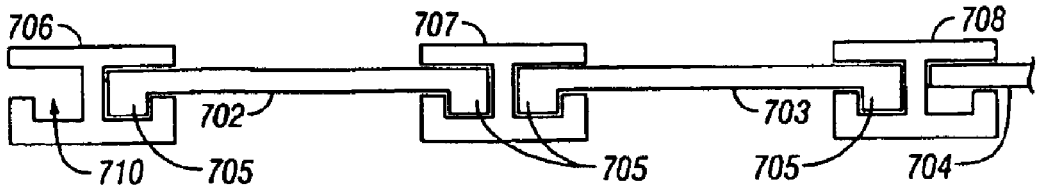
FIG. 7 illustrates yet another embodiment of the invention where each fiber-reinforced panel has a lug along each longitudinal side of the panel.

FIG. 7 illustrates yet another embodiment of the invention where each fiber-reinforced panel 702–703 has a lug 705 along each longitudinal side of the panel. The interlocks 706–708 each have interlocking grooves 710 which join the panels 702–703 while permitting the panels to slide in the longitudinal direction so that they may be driven into the ground. According to one implementation of the invention the interlocks may be designed to provide for some clearance (e.g., one-sixteenth of an inch) with the panels.

The system of interlocks illustrated in FIG. 7 may also be interconnected with a panel 704 which has been cut to size, thereby removing one of the lugs along one edge of the panel 704. The edge without a lug can still be inserted into the groove or channel and, once it has been driven into the ground, may be secured to interlock 708 by bolts or fasteners. In other embodiments of the invention, interlock 708 may be replaced by an interlock 602 as shown in FIG. 6.

Figure 8:
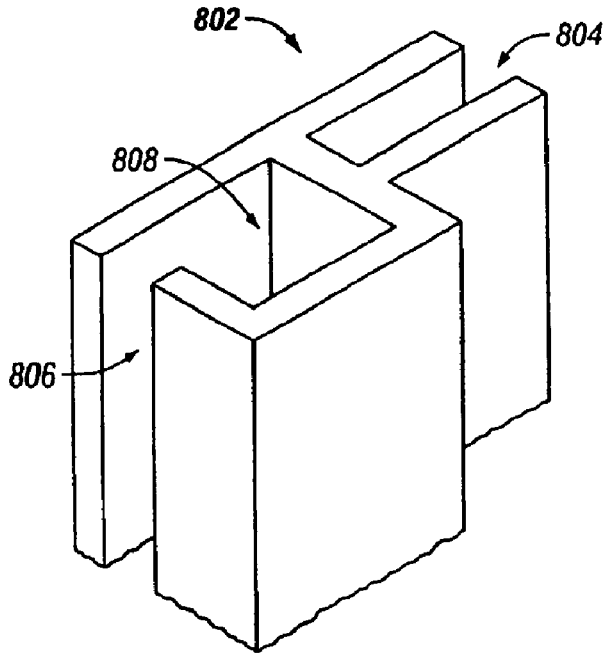
FIG. 8 illustrates a perspective view of an interlock according to one embodiment of the invention.

FIG. 8 illustrates a perspective view of an interlock 802 according to one embodiment of the invention. The interlock 802 includes two channels 804 and 806 for joining two panels. A first channel 804 permits a panel to slide in and out and up and down. When conditions dictate, a panel may be cut to a desired width, along a longitudinal side, and inserted into the first channel 804. A second channel 806 includes an interlocking groove 808 that permits a panel to slide up and down but not in and out.

Figure 9:
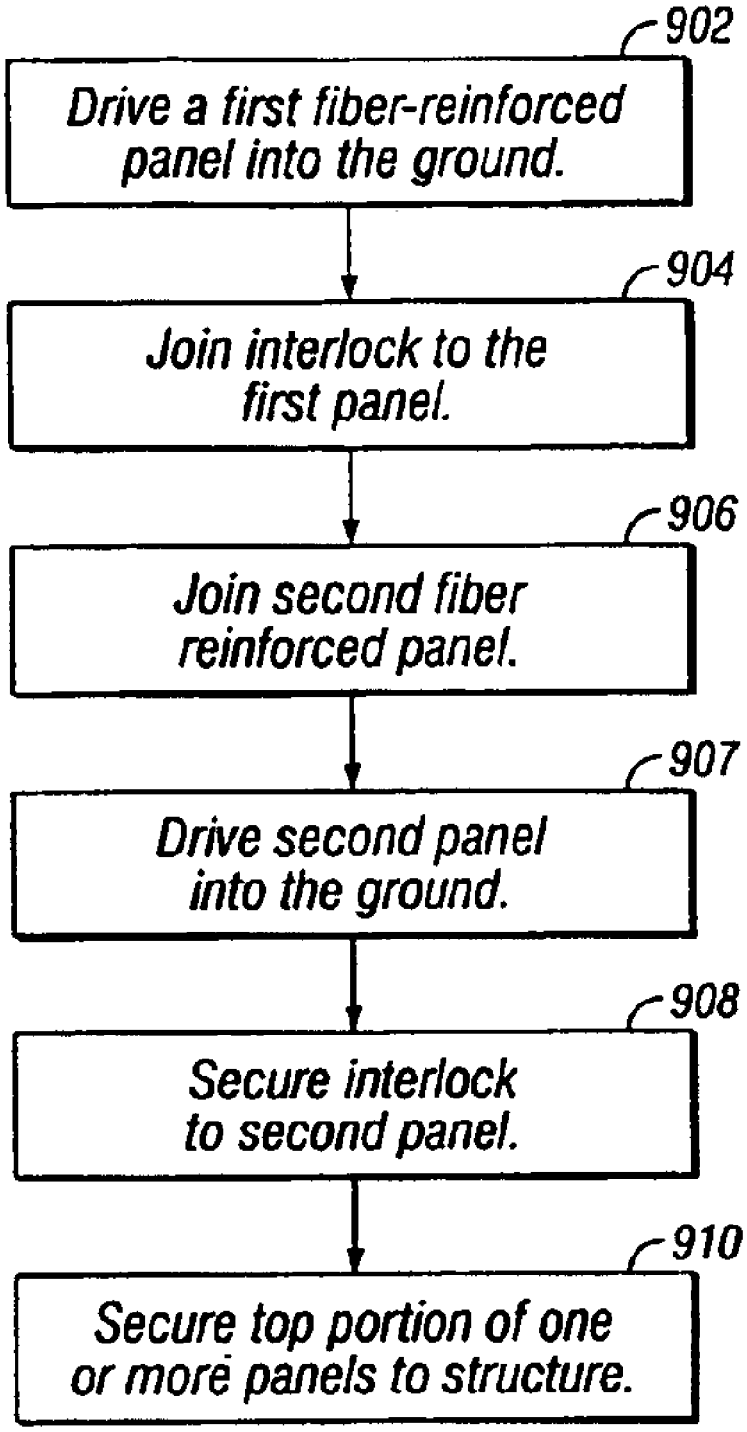
FIG. 9 illustrates a method of assembling an erosion control barrier according to one embodiment of the invention.

FIG. 9 illustrates a method of assembling an erosion control barrier according to one embodiment of the invention. A first fiber-reinforced panel is partially driven into the ground 902. An interlock (e.g., 802) is joined or coupled along one longitudinal side of the first panel 904. For example, in one implementation the interlock channel 804 (FIG. 8) is joined to the non-lug side of the first panel and attached to the first panel using bolts or other fasteners. In a second implementation the interlock channel 806 (FIG. 8) may be slid over the lug side of the first panel and held in place by the interlocking groove 808. A second fiber-reinforced panel is joined to the interlock 806, 906, either in channel 804 or 806, and partially driven into the ground 808, 907. If joined to channel 804 of the interlock, then it is secured to the interlock 908 after the second fiber-reinforced panel has been driven into the ground. In one implementation, the top portion of one or more panels may be attached to the structure being protected 910.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A bulkhead system comprising:

a plurality of fiberglass-core panels arranged as an erosion control wall extending below ground level to prevent erosion, each fiberglass-core panel including at least one lug along a longitudinal side of the panel, the fiberglass-core panels having a longitudinal axis substantially parallel to a direction in which the fiberglass-core panels are driven below ground level;

one or more layers of resin-impregnated carbon fiber sheets coupled to both sides of the plurality of fiberglass-core panels to reinforce and increase the structural strength of the fiberglass-core panels, the carbon fiber sheets including unidirectional carbon fiber along the longitudinal axis of the fiberglass-core panel; and one or more interlocks joining the plurality of fiberglass-core panels, each interlock including at least one interlocking channel to permit a panel to slide up and down while still securing the panel to an adjacent panel.

2. The bulkhead system of claim 1 wherein the one or more fiber-reinforced panels are to be partially driven into the ground, along the longitudinal axis of each panel, to form a continuous wall for erosion control.

3. The bulkhead system of claim 1 wherein each interlock extends substantially the length of each fiber-reinforced panel which is to remain above ground when installed.

4. The bulkhead system of claim 1 wherein a fastener couples an interlock to each fiber-reinforced panel.

5. The bulkhead system of claim 1 further including:

grout pressure-injected below ground level through holes in the fiberglass-core panels to fill any voids that may be present below ground level.

6. The bulkhead system of claim 1 wherein the plurality of fiber-reinforced panels having a thickness of approximately five-eights of an inch.

7. The bulkhead system of claim 1 wherein the one or more layers of resin-impregnated carbon fiber sheets have a thickness of approximately one-sixteenth of an inch.

8. The bulkhead system of claim 1 wherein the vinyl ester resin is used to impregnate the one or more layers of carbon fiber sheets to both sides of the plurality of fiberglass-core panels.

9. A fiber-reinforced panel for an erosion control bulkhead wall, the fiber-reinforced panel comprising:

fiberglass-core panel, the fiberglass core panel having a longitudinal axis substantially parallel to a direction in which the fiberglass-core panels are driven below ground level;

one or more layers of resin-impregnated carbon fiber sheets coupled to both sides of the fiberglass-core panel to reinforce and increase the structural strength of the fiberglass-core panels, the carbon fiber sheets including unidirectional carbon fiber in along the longitudinal axis of the fiberglass-core panel, the fiber-reinforced panel having a thickness of approximately five-eights of an inch; and at least one lug along one longitudinal edge of the fiber-reinforced panel.

10. A fiber-reinforced panel of claim 9 wherein the lug for slideably securing the panel to an interlock.

11. A fiber-reinforced panel of claim 9 wherein the lug is integral with the panel.

12. An bulkhead system comprising:

a fiberglass-core panel means extending below ground level to prevent erosion, fiberglass-core panel means having a longitudinal axis substantially parallel to a direction in which the fiberglass-core panels means are driven below ground level, the fiber-reinforced panel means including at least one lug along a longitudinal side of the panel means;

one or more layers of resin-impregnated carbon fiber means coupled to both sides of the plurality of fiberglass-core panels means to reinforce and increase the structural strength of the fiberglass-core panel means, the carbon fiber means including unidirectional carbon fiber along the longitudinal axis of the fiberglass-core panel means; and an interlocking means for joining the fiber-reinforced panels means to other panel means, the interlocking means including at least one interlocking channel to permit a panel to slide up and down while still securing the panel to an adjacent panel.

13. The bulkhead system of claim 12 further comprising:

a fastening means for coupling the interlocking means to the fiberglass-core panels means panel means.

14. A method of constructing a bulkhead erosion control wall comprising:

driving a first fiber-reinforced panel partially into the ground, the first fiber-reinforced panel including a fiberglass-core panel and at least one lug along a longitudinal side of the panel, the fiberglass-core panel having a longitudinal axis substantially parallel to a direction in which the first fiber-reinforced panel is partially driven below ground level;

one or more layers of resin-impregnated carbon fiber sheets coupled to both sides of the fiberglass-core panel to reinforce and increase the structural strength of the fiberglass-core panel, the carbon fiber sheets including unidirectional carbon fiber along the longitudinal axis of the fiberglass-core panel;

joining an interlock to the first fiber-reinforced panel above ground level;

joining a second fiber-reinforced panel to the interlock;

driving a second fiber-reinforced panel partially into the ground; and injecting grout below ground level through holes in the fiberglass-core panel to fill any voids that may be present below around level.

15. The method of claim 14 further comprising:

fastening the interlock to the first fiber-reinforced panel.

16. The method of claim 14 wherein joining the second fiber-reinforced panel to the interlock includes slideably joining interlock to the second fiber-reinforced panel so that the second fiber-reinforced panel is secured to the first fiber-reinforced panel while still capable of sliding up and down.

17. The method of claim 14 further comprising securing the top of the first fiber-reinforce panel to a structure to provide support for lateral loads.

18. The method of claim 14 wherein the interlock extends along the length of the first fiber-reinforced panel which remains above ground.

19. The method of claim 14 wherein the fiberglass-core panel and one or more layers of resin-impregnated carbon fiber sheets have a thickness of approximately five-eights of an inch.

* * * * *